US006511195B2

(12) United States Patent
Marinacci

(10) Patent No.: US 6,511,195 B2
(45) Date of Patent: Jan. 28, 2003

(54) STREET LAMP TO CARRY A LUMINOUS PLATE AND FOR LIGHTING

(75) Inventor: Angelo Marinacci, Milan (IT)

(73) Assignee: Fonderal S.r.l., Casarile (IT)

( * ) Notice: Subject to any disclaimer, the term of this patent is extended or adjusted under 35 U.S.C. 154(b) by 0 days.

(21) Appl. No.: 09/880,154

(22) Filed: Jun. 12, 2001

(65) Prior Publication Data

US 2002/0172050 A1 Nov. 21, 2002

(30) Foreign Application Priority Data

May 17, 2001 (IT) ..... MI2001A001018

(51) Int. Cl.[7] ..... F21V 21/02; G09F 13/04

(52) U.S. Cl. ..... 362/43; 362/28; 362/812; 40/564

(58) Field of Search ..... 362/431, 370, 362/371, 812, 410, 28; 40/575, 568, 557, 544, 549, 564, 546

(56) References Cited

U.S. PATENT DOCUMENTS

| | | | | | |
|---|---|---|---|---|---|
| 2,316,539 | A | * | 4/1943 | Patterson | 40/572 |
| 5,048,210 | A | * | 9/1991 | Taylor et al. | 40/575 |
| 5,729,924 | A | * | 3/1998 | Reading | 40/564 |
| 5,950,340 | A | * | 9/1999 | Woo | 40/564 |
| 6,009,650 | A | * | 1/2000 | Lamparter | 40/572 |
| 6,341,440 | B1 | * | 1/2002 | Lee | 40/546 |
| 6,367,180 | B2 | * | 4/2002 | Weiss et al. | 40/580 |
| 6,241,369 | B1 | * | 6/2002 | Mackiewicz | 362/368 |
| 6,445,373 | B1 | * | 9/2002 | Yamamoto | 345/102 |

* cited by examiner

*Primary Examiner*—Sandra O'Shea
*Assistant Examiner*—Anabel Ton
(74) *Attorney, Agent, or Firm*—Michael J. Striker

(57) ABSTRACT

Horizontal street lamp (10) of an oblong concave structure housing a source of light, with a downward-facing mouth in whose center is applied a frame (60) with a cavity into which a substantially vertical plate (80) can be freely inserted, said plate being illuminated by a source of light to create a sort of road sign, or for purposes of advertising, decoration generally.

10 Claims, 4 Drawing Sheets

Figure 1:
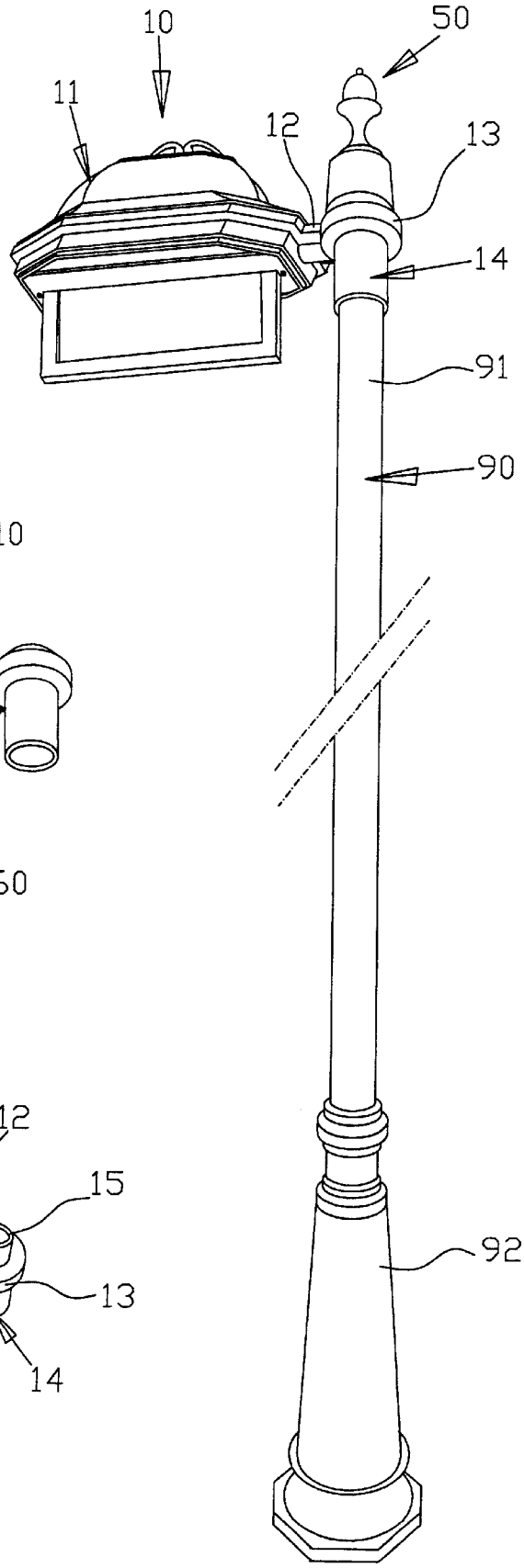

FIG.6
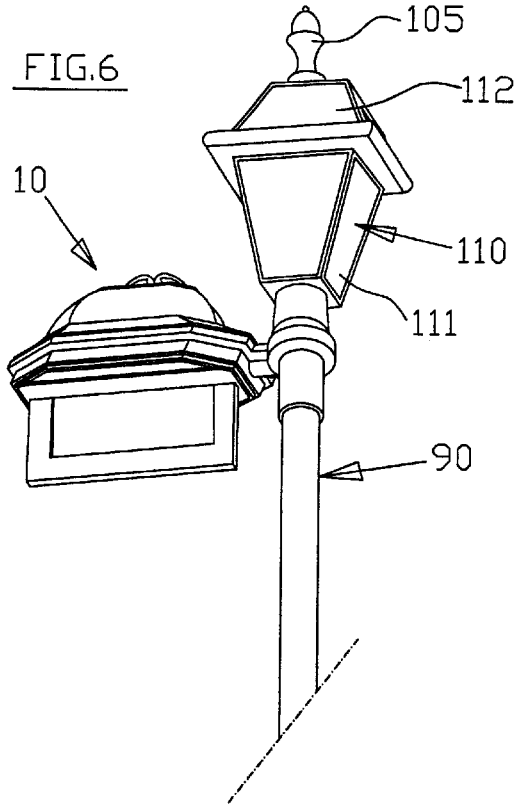
FIG.5
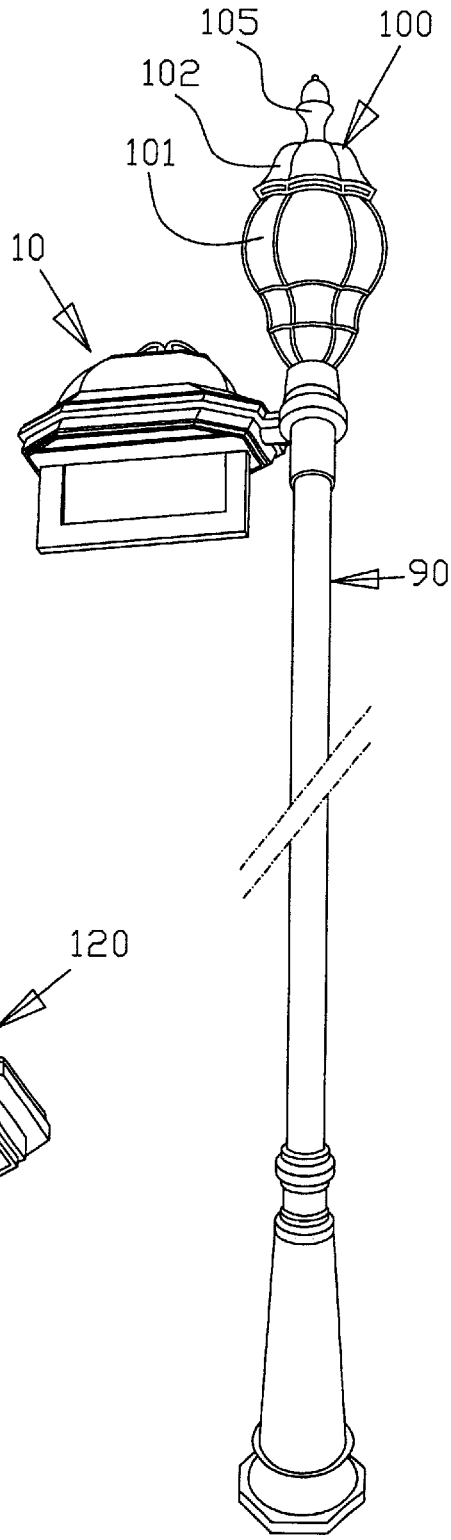
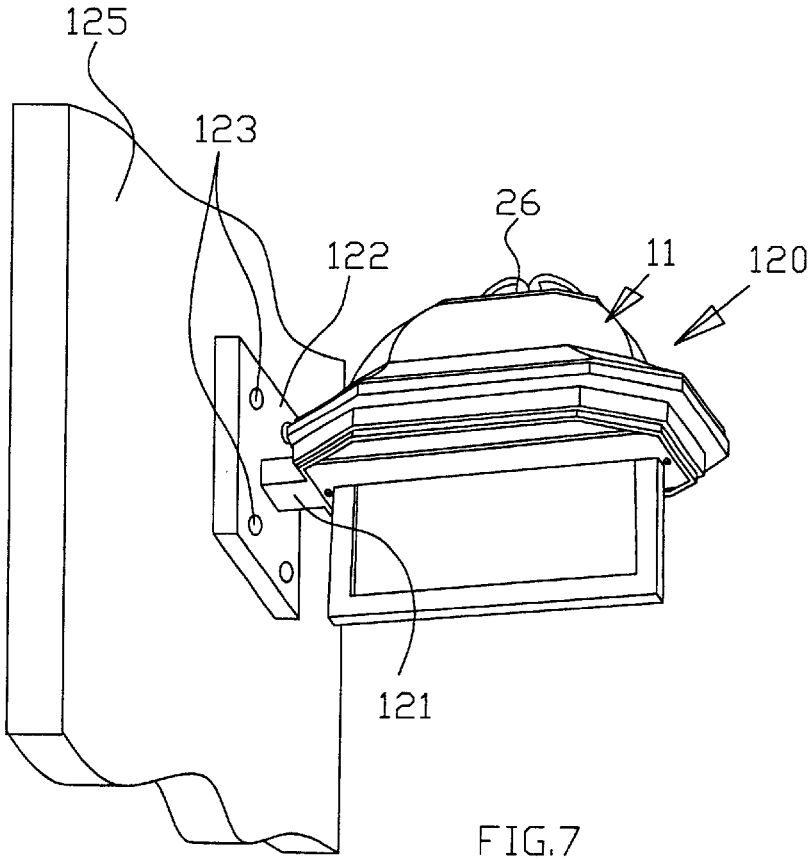
FIG.7

STREET LAMP TO CARRY A LUMINOUS PLATE AND FOR LIGHTING

A variety of lamps are in common use for lighting streets and squares, as are also many types of plates for road signs or for advertising purposes generally.

Unless such signs are situated close to a source of light, after sundown they become illeggible or simply go unnoticed.

In view of their importance, however, the fact of their being barely visible may constitute serious inconvenience.

The provision of separate lighting for these signs would generally be either too costly or unpractical because of the damage caused to them by weather conditions.

The above disclosure suggests a solution to these problems offering considerable economic and practical advantages as will now be explained.

Subject of the invention is a horizontal street lamp presenting an oblong concave structure that houses a source of light with a downward facing mouth to which is applied a substantially vertical metal sheet illuminated by the source of light so that it becomes a sort of plate for road signs, for publicity messages or for decorative purposes.

The lamp may be slightly out of the vertical, preferably at an angle of about 30°.

The source of light is a lamp laid longitudinally inside the concave structure and projecting from a longitudinal arm.

A decorative moulding may be placed on top of the concave structure.

In one type of execution the vertical sheet is rectangular and is fitted into a rectangular frame substantially in the form of a squared "U", fixed uppermost to a narrow oblong plate whose shape and size correspond to those of the longitudinal area inside the mouth. Said frame presents a cavity whose cross section is substantially that of a squared "U" on the three sides, facing inwards at the position of an axial slit in said plate.

The internal dimensions of the cavity and of the slit are such as to permit the sheet to be taken out and replaced with another. The arrow oblong plate may be advantageously placed on the longitudinal axis of the mouth so that the vertical sheet is lit up by the source of light inside the concave structure, through the lateral longitudinal areas of said mouth left free by said longitudinal plate. These lateral areas left free by the longitudinal plate are closed by a pair of wing-shaped extensions that allow light to pass and are fixed at the longitudinal edges of said plate.

Advantageously the frame is fixed to the mouth of the concave structure by two screws which, passing through a hole made for each one at the two ends of the oblong plate left free of the frame, screw into threaded holes made in a bracket fixed to each internal end of the mouth.

Advantageously the mouth of the concave structure is rectangular in shape with trapezoidal ends whose greater base is formed by the short sides of the rectangle.

In one type of execution a tubular connection is fixed to the end of the arm, to fit onto the lamp pole at the top of which is a decorative moulding.

Advantageously, at a short distance from the mouth, there is a continuous raised rib on the outside of the concave structure; this extends onto the arm and surrounds the tubular connection whose upper end is of a smaller diameter into which a decoratively-shaped top may be fitted.

In another execution the street light here described is placed at the upper end of a pole that in turn carries a vertical lamp for street lighting whose shape can be rounded or square.

In another execution an orthogonal base is fixed to the end of the longitudinal arm to which a wall-mounted lamp can be applied.

In another type of execution the vertical sheet that forms the luminous plate is replaced by another which may be transparent or semi-transparent and that covers the mouth of the street lamp allowing light to pass from the source provided.

The invention offers evident advantages.

The association between road signs with publicity messages or other indications and street lamps is of considerable interest not only for practical reasons but also for those of cost as in many cases city lighting may also illuminate the signs referred to above.

All this is possible without encountering problems of bulk or of regulations governing the positioning of these signs, in view of the versatile nature of the different applications, pole or wall-mounted, or simply for illumination.

Characteristics and purposes of the above invention will be made still clearer by the following examples of its execution illustrated by diagrammatically drawn figures.

FIG. 1 Horizontal street lamp for an illuminated sign mounted on a pole, perspective.

Figure 2:
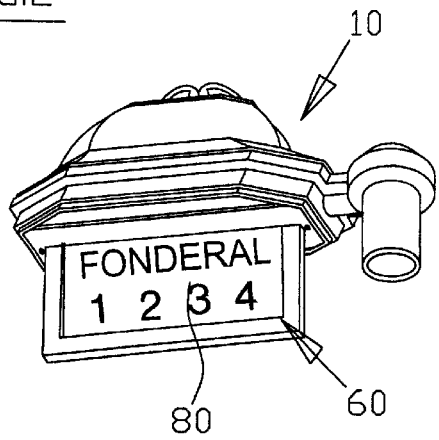

FIG. 2 The horizontal street lamp, perspective from below.

Figure 3:
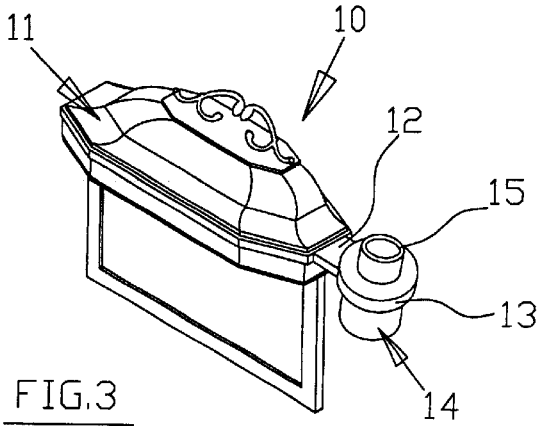

FIG. 3 The horizontal street lamp, perspective from above.

Figure 4:
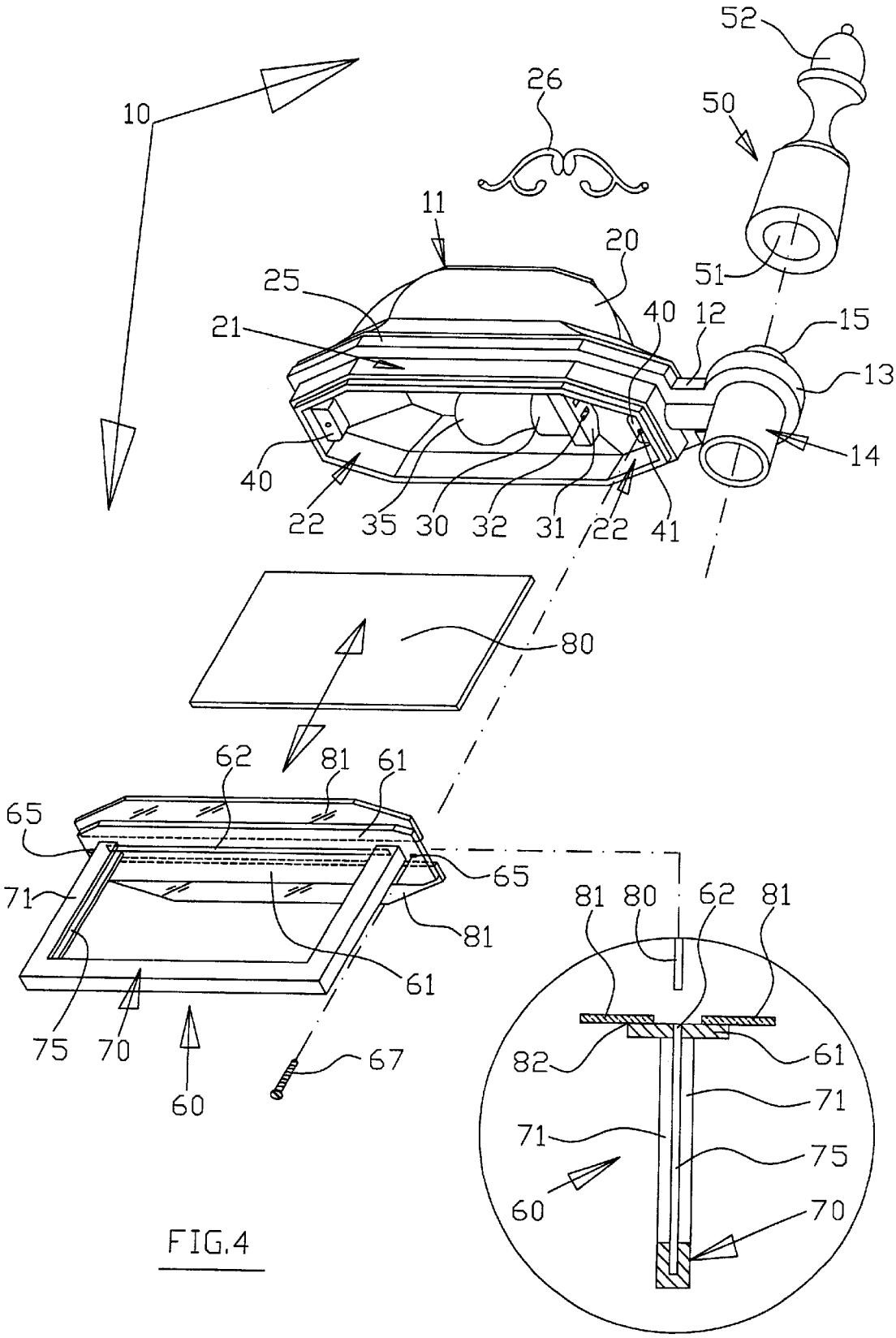

FIG. 4 Exploded perspective view of the horizontal street lamp, with a detail shown in cross section.

FIG. 5 Horizontal pole-mounted street lamp with a rounded vertical lamp, perspective.

FIG. 6 The horizontal pole-mounted street lamp with a vertical square lamp, perspective.

FIG. 7 A wall-mounted horizontal street lamp, perspective.

Figure 8:
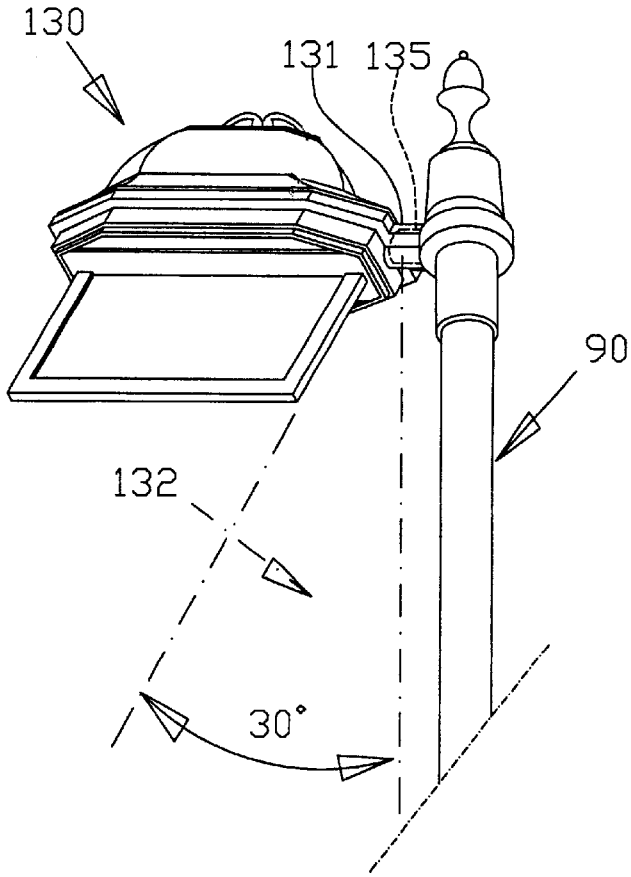

FIG. 8 Horizontal street lamp for an illuminated sign, inclined at 30°.

Figure 9:
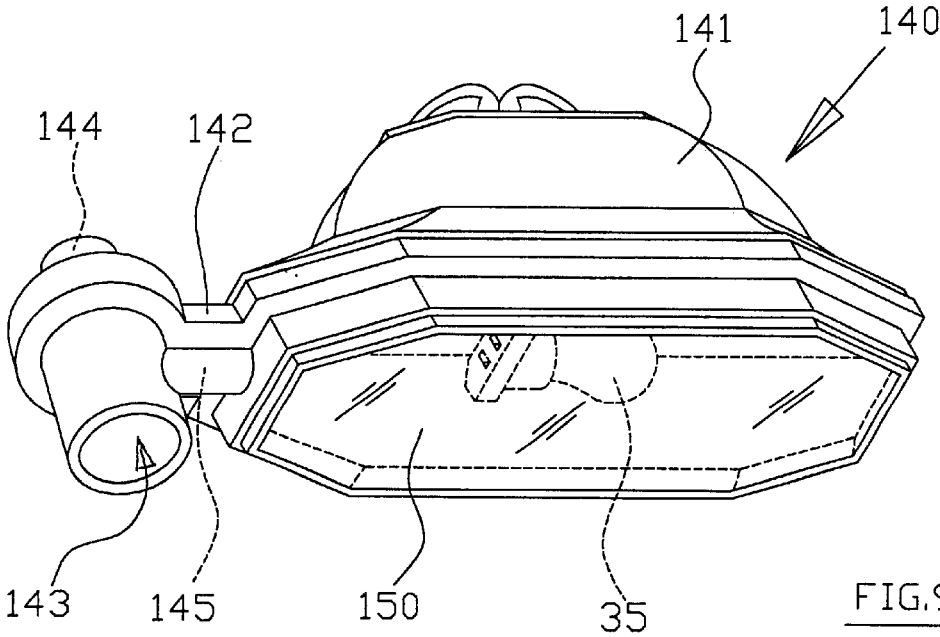

FIG. 9 Horizontal lamp for street lighting, perspective.

The street lamp 10 for luminous signs comprises a concave structure 11 supported by an arm 12 with an annular end 13 and tubular connection 14 applicable to the upper end 91 of a tubular pole 90 mounted on an ornamental base 92 (FIG. 1).

The connection 14 has an upper end 15 of a smaller diameter onto which fits the decorative head 50 with chamber 51 and moulding 52 on the top.

The concave structure 11 of the street lamp presents a dome 20 and an oblong substantially rectangular mouth 21 with trapezoidal-shaped ends 22.

Said mouth 21 is surrounded by a raised rib 25 that extends onto the arm 12 forming an annular end 13.

The dome 20 has a decorative moulding 26 at the top.

The concave structure 11 houses the lampholder 30 for the lamp 35,and a base 31 with holes in it for the passage of electric wires.

A substantially vertical metal sheet 80 is placed in the mouth 21, this sheet being illuminated by the source of light so forming a plate that may serve for a road sign, for a publicity message or for some other indication.

The vertical sheet, or plate, 80 is rectangular and is supported by a rectangular frame 60 substantially shaped like a square "U", at the top of which is a narrow oblong small rectangular plate 61 whose ends are beveled to match, internally, with the trapedzoidal ends of the oblong mouth 21, while the three sides of the "U" fit into a continuous internal cavity 75, also having a U-shaped inward-facing cross section.

At the position of this cavity 75 there is a slit 62 of the same length in the narrow plate 61 and into this the rectangular plate 80 can slide and be taken out for replacement if needed, its dimensions being the same, allowing for a suitable amount of play, as those of said cavity 75.

The length of the frame 60 is less than the length of the narrow plate 61, to allow holes 65 to be made through it for screws 67 to hold the frame to the mouth 21 of the concave structure 11, said screws then screwing in the threaded holes 41 of a bracket 40 fixed to the internal ends 22 of said mouth 21.

The pair of semi-transparent extensions 81 are fixed with glue 82 along the longitudinal edges of said narrow plate 61.

FIG. 5 shows the horizontal street lamp 10 mounted on a pole 90 that carries a vertical lamp 100 with a cowl 101, dome 102 and moulding 105.

FIG. 6 illustrates the horizontal lamp 10 mounted on a pole 90 that carries a vertical lamp 110 with squared cowl 111, top 112 and moulding 105.

FIG. 7 illustrates the horizontal lamp 120 joined by an arm 121 to the base 122 with holes 123 for mounting it on the wall 125.

FIG. 8 illustrates the horizontal lamp 130 at an angle 132 of substantially 30° in relation to the pole 90 onto which it is mounted by the arm 131, there being through said arm a hole 135 for the passage of electric wires.

FIG. 9 illustrates the horizontal lamp 140 and arm 142 through which is a hole 145 for the passage of electric wires for the connecting part 143, 144.

The semi-transparent sheet 150 screens the light of the lamp 35.

What is claimed is:

1. Horizontal street lamp (10, 120, 130), comprising:

an oblong concave structure ( 11) housing a source of light (35), with a downward facing mouth (21) in which a substantially vertical plate (80) is mounted illuminated by the source of light (35) so as to form a plate for road signs, advertisements, other indications, or decorations generally, wherein the vertical plate (80) is rectangular and is supported by a substantially squared-U-shaped rectangular frame (60) fixed at the top to a narrow oblong plate (61), dimensions and shape corresponding to those of an internal longitudinal area of the mouth (21) and with a cavity (75), whose cross section on three sides is substantially shaped like a squared U, facing inwards, at a position of an axial slit (62) in said narrow plate (61), wherein internal dimensions of the cavity (75) and of the slit (62) permit free insertion and replacement of the plate (80).

2. Horizontal street lamp (10, 120, 130, 140) as in claim 1, wherein the outwardly-projecting concave structure (11) is supported by a longitudinal arm (12, 121, 131, 142), wherein a tubular connection (14) for fitting onto a lamp pole (90) is fixed to the end of the arm (12, 131, 142).

3. Horizontal street lamp (10, 120, 130) as in claim 1, wherein the narrow oblong plate (61) is placed on a longitudinal axis of the mouth (21) permitting illumination of the vertical plate (80) by the source of light (35) inside the concave structure (20), through lateral longitudinal areas of said mouth left free by said narrow oblong plate (61).

4. Horizontal street lamp (10, 120, 130) as in claim 1, wherein lateral areas of the mouth left free by the narrow oblong plate (61) are closed by a pair of extensions (81) made of a material that allows passage of light, fixed at longitudinal edges of said narrow oblong plate (61).

5. Horizontal street lamp (10, 120, 130) as in claim 1, wherein the frame (60) is fixed to the mouth of the concave structure (11), by two screws (67) that, passing through holes (65) present at the two ends of the oblong narrow plate (61) left free by the frame (60), screw into threaded holes (41) made in a bracket (40) fixed to each of the internal ends (22) of the mouth (21).

6. Horizontal street lamp (10, 120, 130, 140) as in claim 1, wherein the mouth (21) of the cocave structure (11) is rectangular in shape with trapezoidal ends the greater base of which is formed by the short sides of the rectangle.

7. Horizontal street lamp (10, 130, 140) as in claim 2, wherein, at a short distance from the mouth (21) the concave structure (11) externally presents a continuous raised rib (21) that extends to the arm (12, 131, 142) and on to surround the tubular connection (14, 143).

8. Horizontal street lamp (10, 120, 130, 140) as in claim 5, wherein an upper part of the tubular connection (14) is of a smaller diameter to facilitate application of a decorate moulding (60).

9. Horizontal street lamp as in claim 5, wherein a pole (90) is provided to support, in turn, a vertical street lamp (100, 110) for illumination.

10. Horizontal street lamp as in claim 5, wherein an orthogonal base (125) is fixed to an end of the longitudinal arm (121), to permit the horizontal street lamp (120) to be wall mounted.

* * * * *